US005781643A

United States Patent [19]

Anderson

[11] Patent Number: 5,781,643

[45] Date of Patent: Jul. 14, 1998

[54] MICROPHONE PLOSIVE EFFECTS REDUCTION TECHNIQUES

[75] Inventor: Carl Roger Anderson, Wilmette, Ill.

[73] Assignee: Shure Brothers Incorporated, Evanston, Ill.

[21] Appl. No.: 698,957

[22] Filed: Aug. 16, 1996

[51] Int. Cl.[6] ..... H04R 25/00

[52] U.S. Cl. ..... 381/168; 381/169; 381/155

[58] Field of Search ..... 381/168, 169, 381/69, 68.3, 68.6, 155; 181/184, 242, 130

[56] References Cited

U.S. PATENT DOCUMENTS

| | | | |
|---|---|---|---|
| 3,236,328 | 2/1966 | Burroughs | 381/169 |
| 3,548,121 | 12/1970 | Gorike | 381/168 |
| 3,963,881 | 6/1976 | Fraim et al. | 381/168 |
| 3,989,905 | 11/1976 | Anderson et al. | 381/168 |
| 3,995,124 | 11/1976 | Gabr | 381/168 |
| 4,123,622 | 10/1978 | Macleod | 381/168 |
| 4,742,887 | 5/1988 | Yamagishi | 381/168 |
| 4,811,405 | 3/1989 | Peiker | 381/168 |
| 4,887,693 | 12/1989 | Plice | 381/183 |
| 4,965,775 | 10/1990 | Elko et al. | 381/168 |
| 4,966,252 | 10/1990 | Drever | 381/169 |
| 5,282,245 | 1/1994 | Anderson | 381/168 |
| 5,444,790 | 8/1995 | Kogen | 381/168 |

*Primary Examiner*—Curtis Kuntz
*Assistant Examiner*—Rexford N. Barnie
*Attorney, Agent, or Firm*—Banner & Witcoff, Ltd.

[57] ABSTRACT

A microphone for reducing distortion of an audio signal due to wind or plosive sounds emitted by a user, including a microphone cartridge defining a central axis and a cylinder contiguous with the perimeter of the cartridge. A windscreen defines first, second and third acoustical paths. The first and second paths are through the side of the windscreen and the third path is along the axis of the windscreen. The third path has an acoustical resistance greater than the first or second paths. The second path has an acoustical resistance greater than the first path.

17 Claims, 1 Drawing Sheet

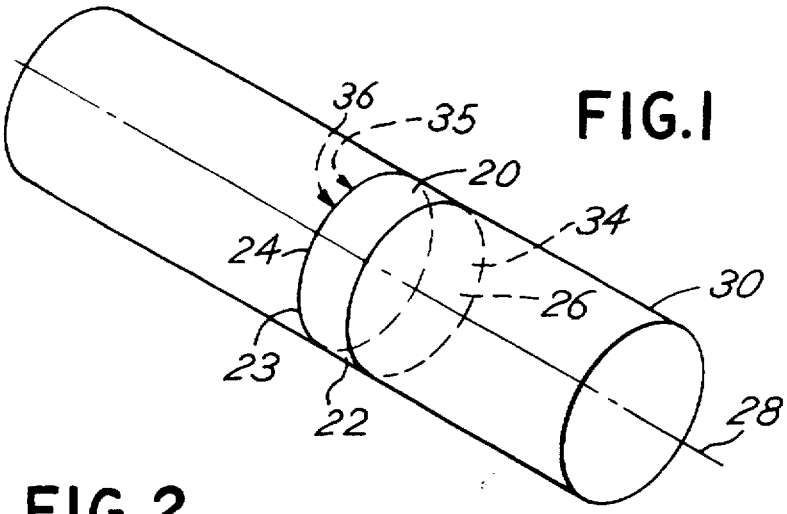
FIG.1
FIG.2
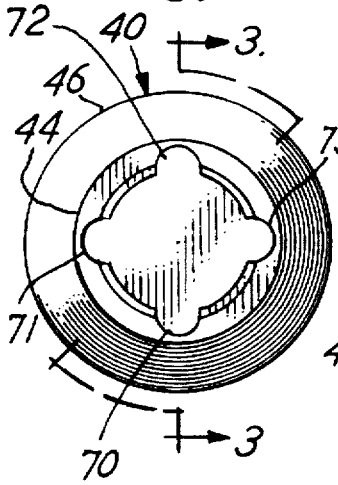
FIG.3
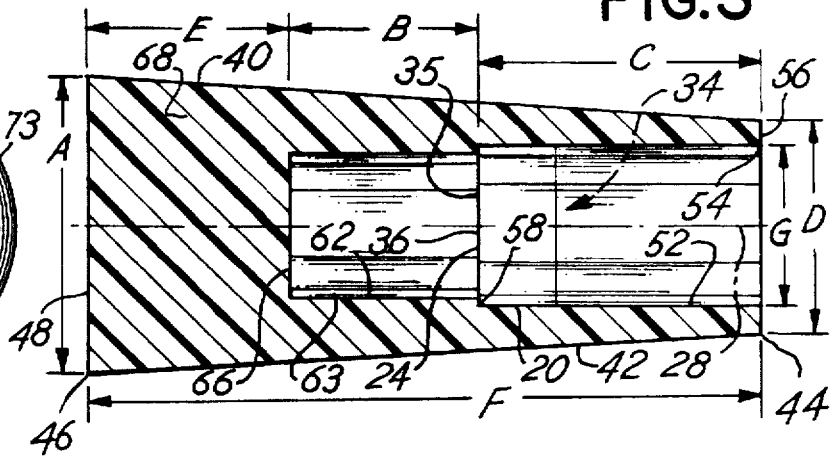
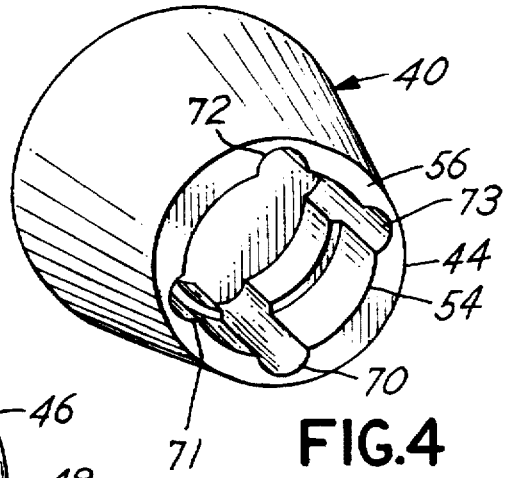
FIG.4
FIG.5
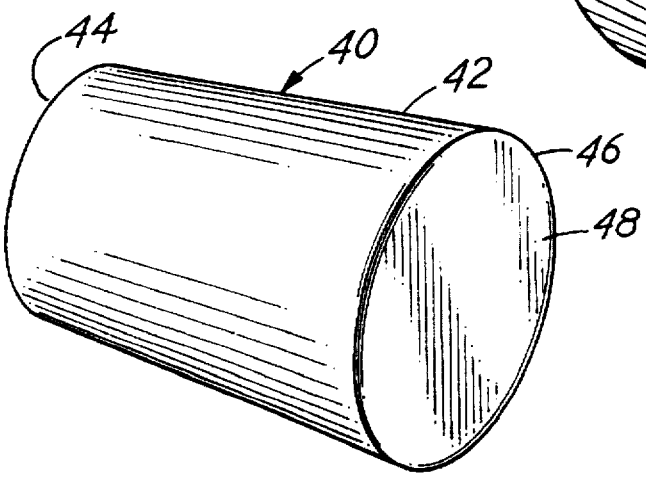

MICROPHONE PLOSIVE EFFECTS REDUCTION TECHNIQUES

BACKGROUND OF THE INVENTION

1. Field of the Invention

This invention relates to techniques for reducing distortion of microphone audio signals, and more particularly relates to microphone windscreens for reducing distortion due to wind or plosive sounds emitted by a user.

2. Description of Related Art

During the past few years, personal computers have developed sufficient speed and memory to execute a class of programs generally known as voice recognition software. Such software requires the use of a microphone which converts words spoken by a user into analog signals. The analog signals are converted to digital signals that are processed by the computer. After processing, the digital signals may be used to execute various commands (e.g., opening a file) based on the recognition of one or more words spoken by the user. In one class of voice recognition software, words spoken by the user are transcribed by the computer into computer files representing text that can be edited by word processing programs.

Experience has shown that the microphone used in connection with the software is critically important. If the microphone produces a distorted audio signal due to wind or plosive sounds emitted by the user, the voice recognition software is unable to execute the desired command or produce the expected computer text, thereby bewildering and frustrating the user.

Plosive sounds are those which require the emission of a substantial amount of air in order to articulate the sound. Examples of plosive sounds are the consonants "p" and "t". In the past, the adverse effects of plosive sounds have been dealt with by employing a foam windscreen around the microphone. The manufacture of the reticulated foam and the design of windscreens is represented in the patent literature. Although effective, this means increases the cost, size and complexity of the microphone.

U.S. Pat. No. 3,989,905 (Anderson et al., issued Nov. 2, 1976) describes a unidirectional microphone capable of reducing electrical output due to mechanical shock applied to the microphone casing. While such a microphone is useful for shock mounting, it would not provide the type of acoustical response necessary to eliminate microphone "pop" due to wind or plosive sounds emitted by a user. The present invention solves the problem presented by such sounds by providing a rigid, porous plastic enclosure for the acoustic system which also functions as the microphone case. Moreover, the problem has been solved with low cost components.

SUMMARY OF THE INVENTION

The invention is useful in connection with a microphone for generating an electrical audio signal corresponding to the speech of a user. In such an environment, the invention enables the reduction of distortion of the microphone audio signal due to wind or plosive sounds emitted by the user. According to a preferred embodiment, a microphone cartridge generates an audio signal. The cartridge defines a perimeter, as well as front and rear entries. The cartridge also defines a central axis generally perpendicular to the front and rear entries and also defines a cylinder generally contiguous with the perimeter having a longitudinal axis lying along the central axis. First, second and third acoustical paths provide varying acoustical resistance that enables the reduction of distortion of the audio signal. The first acoustical path extends to the front surface through the cylinder, and the second acoustical path extends to the rear surface through the cylinder. The third acoustical path extends to the front surface along the central axis. According to the preferred embodiment, the third acoustical path has an acoustical resistance greater than the resistance of the first or second paths.

According to another embodiment, the first, second and third acoustical paths are formed by a porous plastic material which carries the microphone cartridge. Coupling air channels may be provided in the material which acoustically couple the front and rear surfaces of the cartridge.

By using the foregoing techniques, the distortion of an audio signal produced by the cartridge due to wind or plosive sounds emitted by the user may be substantially reduced. As a result, voice recognition software used in connection with the microphone provides substantially greater accuracy when it transcribes the voice of the user into computer commands or text.

BRIEF DESCRIPTION OF THE DRAWINGS

These and other advantages and features of the invention will become apparent upon reading the following detailed description and referring to the accompanying drawings in which like numbers refer to like parts throughout and in which:

FIG. 1 is a diagrammatic illustration of a preferred form of microphone cartridge and various geometrical and acoustical features of the invention;

FIG. 2 is an end elevational view of a preferred form of combined windscreen and housing embodying the invention;

FIG. 3 is a cross-sectional view taken along line 3–3 of FIG. 2;

FIG. 4 is a perspective view of the windscreen and housing shown in FIG. 2; and

FIG. 5 is a perspective view of the windscreen and housing shown in FIG. 4 and rotated end over end with respect to FIG. 4.

DESCRIPTION OF THE PREFERRED EMBODIMENTS

Referring to FIG. 1, a preferred form of the invention may employ a conventional electret microphone cartridge 20, such as model EM 110 manufactured by Primo Microphones, Inc., McKinney, Tex. An electret cartridge is preferred for its ruggedness and low price. Cartridge 20 defines a perimeter 22 which is shown as a circle, but which may comprise any closed curve 23. Cartridge 20 also defines a front entry 24, a rear entry 26 and a central axis 28 which is generally perpendicular to front entry 24 and rear entry 26. Cartridge 20 also defines a cylinder 30 having an axis which is co-linear with central axis 28 and which intersects the closed curve defined by perimeter 22 of cartridge 20. Although cylinder 30 is shown in FIG. 1 as having a fixed radius, the cylinder may take a variety of other shapes depending on the type of closed curve defined by perimeter 22.

Cartridge 20 and cylinder 30 define acoustical paths 34–36, each of which has a different acoustical resistance. Path 34 extends through cylinder 30 to rear entry 26; acoustical path 35 extends through cylinder 30 to front entry 24 and acoustical path 36 extends along axis 28 to front entry 24. Path 35 may have an acoustical resistance greater than the acoustical resistance of path 34. Path 36 preferably has an acoustical resistance greater than the acoustical resistance of either path 34 or 35.

The acoustical resistance must be much less than the impedance of the sound entries of the cartridge. If this stipulation is not followed, the response and polar pattern will be affected.

Referring to FIGS. 2–5, the acoustical paths 34–36 preferably are defined by a combined housing and windscreen 40. Windscreen 40 defines a truncated conical outside surface 42 having a rear circular edge 44 with a diameter D and front circular edge 46 having a diameter A. Windscreen 40 also defines a front planar surface 48 lying within front edge 46 and lying in the plane defined by front edge 46.

Windscreen 40 also defines a rear cylindrical inner surface 52 having a diameter G and a length C, as well as a rear circular edge 54. The portion of windscreen 40 between edges 44 and 54 defines a ring 56. Cylindrical surface 52 terminates in a ring-shaped stop shoulder 58 against which front entry 24 of cartridge 20 rests.

Windscreen 40 also defines a front cylindrical surface 62 that defines an air cavity 63 having a length B and a diameter of 0.350 inches in one embodiment of the invention. Cylindrical surface 62 defines a front planar circular surface 66. Windscreen 40 has a thickness E between surfaces 48 and 66 that helps to define the acoustical resistance of path 36 (FIG. 3).

Windscreen 40 is integrally molded from a porous plastic material 68, such as a custom formulated copolymer manufactured by General Polymeric, Inc., Reading, Pa. About 30 to 50 percent of the material of windscreen 40 comprises pores that allow sound waves to enter the interior of the windscreen 40. The pores have an average diameter of 80 to 100 microns.

As shown in FIG. 3, cartridge 20 is carried by cylindrical surface 52 and is held in place by a conventional press fit. As shown in FIGS. 2 and 4, vents 70, 71, 72 and 73 are integrally molded in surfaces 52 and 62 in order to define coupling channels. The vents 70 and 73 are substantially identical, with vents 70, 72 and 71, 73, respectively, located on opposite sides of cartridge 24. The vents 70–73 couple sound waves between front entry 24 and rear entry 26 of cartridge 20, providing a subsonic low frequency rolloff. This reduces the low frequency transient caused by wind and plosive sounds.

Referring to FIG. 3, windscreen 40 has a thickness along path 34 of 0.060 to 0.090 inches; along path 35 of 0.118 to 0.149 inches, and along path 36 of 0.445 inch. Providing windscreen 40 with a thickness along path 36 that is greater than the thickness along paths 34 or 35 is an important feature which helps reduce distortion of an audio signal produced by cartridge 20 due to wind or plosive sounds (pops) emitted by the user. Such sounds may occur when the user articulates the consonants "p" and "t".

Air cavity 63 between cartridge 20 and surface 66 also is an important feature. Preferably, the thickness of material 68 along axis 28 is at least 0.5 times the thickness of cavity 63 along axis 28 (i.e., thickness B). The arrangement of cavity 63 in relationship to material 68 along axis 28, together with the reduced thickness of the material adjacent cavity 63, also is an important feature which tends to reduce distortion in the audio signal produced by cartridge 20 due to wind or plosive sounds. By having a substantial thickness of material 68 between surface 48 and 68, sound entry is forced to occur along paths 34 or 35 where the airstream is less turbulent.

Vents 70, 71, 72 and 73 are also an important feature which reduces distortion in the audio signal produced by cartridge 20.

The dimensions shown in FIG. 3 preferably have the values stated in the following Table I:

TABLE I for a 1 cm cartridge

| Dimension | Value in Inches |
|---|---|
| A | 0.720 |
| B | 0.475 |
| C | 0.650 |
| D | 0.520 |
| E | 0.445 |
| F | 1.57 |
| G | 0.400 |

By using the foregoing techniques, distortion in an audio signal produced by an inexpensive microphone cartridge due to wind or plosive sound emitted by the user can be reduced to a degree unattainable by prior art techniques.

Those skilled in the art will recognize that the preferred embodiments may be altered or amended without departing from the true spirit and scope of the invention, as defined in the accompanying claims.

I claim:

1. In a microphone for generating an electrical audio signal corresponding to speech of a user; improved apparatus for reducing distortion of said audio signal due to wind or plosive sounds emitted by the user comprising in combination:

a microphone cartridge for generating said audio signal, said cartridge defining a perimeter, a front entry, a rear entry, a central axis generally perpendicular to said front entry and said rear entry and a cylinder generally contiguous with said perimeter having a longitudinal axis collinear with said central axis;

first means for defining a first acoustical path to said rear entry through said cylinder having an acoustical first resistance;

second means for defining a second acoustical path to said front entry through said cylinder having an acoustical second resistance;

third means for defining a second acoustical path to said front entry along said central axis having an acoustical third resistance greater than said first resistance and greater than said second resistance, whereby distortion of said audio signal is reduced, said first means, second means and third means comprising integrally formed porous material.

2. A microphone, as claimed in claim 1, wherein said material comprises a porous plastic.

3. A microphone, as claimed in claim 1, wherein about 30 to 50 percent of said material comprises pores.

4. A microphone, as claimed in claim 1, wherein said material comprises pores having an average diameter in the range of 80 to 100 microns.

5. A microphone, as claimed in claim 2, wherein said cartridge is carried by said material.

6. A microphone, as claimed in claim 3, wherein said cartridge is held in said material by a press fit.

7. A microphone, as claimed in claim 1, and further comprising an air cavity between said front surface and said material.

8. A microphone, as claimed in claim 7, wherein the thickness of said material along said central axis is at least 0.5 times the thickness of said cavity along said central axis.

9. A microphone, as claimed in claim 7, wherein said thickness of said cavity along said central axis is at least as great as the diameter of said cartridge.

10. A microphone, as claimed in claim 1, wherein said second resistance is greater than said first resistance.

11. A microphone, as claimed in claim 1, and further comprising coupling means defining one or more air channels acoustically coupling said front surface with said rear surface.

12. A microphone, as claimed in claim 11, wherein said coupling means are integrally formed with first means and said second means within said cartridge.

13. A microphone, as claimed in claim 11, wherein said coupling means define a pair of substantially identical air channels located on opposite sides of said cartridge.

14. A microphone, as claimed in claim 1, wherein said porous material defines a windscreen.

15. A method for reducing distortion in a microphone for generating an electrical audio signal corresponding to speech of a user due to wind or plosive sounds emitted by the user wherein said microphone includes a microphone cartridge for generating said audio signal, said cartridge defining a perimeter, a front entry, a rear entry, a central axis generally perpendicular to said front entry and said rear entry and a cylinder generally contiguous with said perimeter having a longitudinal axis collinear with said central axis comprising the steps of providing a first acoustical path to said rear entry through said cylinder having an acoustical first resistance;

providing a second acoustical path to said front entry through said cylinder having an acoustical second resistance;

providing a third acoustical path to said front entry along said central axis having an acoustical third resistance greater than said first resistance and greater than said second resistance; and acoustically coupling said front entry with said rear entry by coupling means that are integrally formed within said cartridge of rigid formed porous material, whereby distortion of said audio signal is reduced.

16. The method, as claimed in claim 15, comprising the step of providing said second resistance with a resistance greater than said first resistance.

17. The method, as claimed in claim 15, comprising the step of acoustically coupling said front entry with said rear entry by a pair of substantially identical air channels located on opposite sides of said cartridge.

* * * * *